US005549760A

United States Patent [19]

Becker

[11] Patent Number: 5,549,760

[45] Date of Patent: Aug. 27, 1996

[54] MOUNTING DEVICE FOR DISHWASHER INSULATION

[75] Inventor: Craig H. Becker, Kinston, N.C.

[73] Assignee: White Consolidated Industries, Inc., Cleveland, Ohio

[21] Appl. No.: 348,371

[22] Filed: Dec. 1, 1994

[51] Int. Cl.[6] ..... B08B 13/00

[52] U.S. Cl. ..... 134/25.2; 134/560; 134/201

[58] Field of Search ..... 411/904, 510, 411/474; 134/201, 560, 570, 580, 18, 25.2, 42

[56] References Cited

U.S. PATENT DOCUMENTS

| | | | |
|---|---|---|---|
| 4,728,238 | 3/1988 | Chisholm et al. | 411/510 |
| 4,902,182 | 2/1990 | Lewis | 411/510 |
| 4,985,106 | 1/1991 | Nelson . | |
| 5,010,943 | 4/1991 | Boyer . | |
| 5,044,705 | 9/1991 | Nelson . | |
| 5,232,322 | 8/1993 | Regensburger | 411/510 |
| 5,246,905 | 6/1995 | Rollhauser et al. . | |
| 5,306,098 | 4/1994 | Lewis | 411/510 |

*Primary Examiner*—Frankie L. Stinson
*Attorney, Agent, or Firm*—Pearne, Gordon, McCoy & Granger

[57] ABSTRACT

A dishwasher tub is provided with insulation mounting bosses on opposite sides. Insulation is hooked over front mounting tabs and draped over the tub. Mounting clips are inserted through the insulation into the bosses. The clip has fingers that engage in apertures of the bosses and a retaining surface that holds the insulation on the tub.

14 Claims, 3 Drawing Sheets

MOUNTING DEVICE FOR DISHWASHER INSULATION

BACKGROUND OF THE INVENTION

1. Field of the Invention

This invention relates generally to the field of dishwashers and specifically to an insulation mounting assembly therefor.

2. Description of the Related Art

Dishwashers and other washing devices commonly include a molded or formed enclosure in which washing occurs. The enclosure is typically a cubic shape having an open front. To limit the escape of noise and heat from the enclosure, insulation is provided on an external surface of the enclosure. The insulation is generally provided on the top and opposing sides of the enclosure and may also be provided on the rear and bottom. The insulation is provided as a sheet or batt of insulating material, such as fiberglass, adapted to be secured on the enclosure. An example of such insulation is shown in U.S. Pat. Nos. 4,985,106 and 5,044,705 to Nelson, which are incorporated herein by reference.

The insulation is secured to the enclosure a number of different ways. For example, a bar or strap is placed over lower ends of the insulation. Ends of the strap are secured to tabs extending from the enclosure by a polypropylene clip projecting through the strap and engaging in a hole through the tab, as shown in FIG. 1. Another manner of mounting the insulation is shown in FIG. 2. Mounting holes are provided near lower ends of the insulation. The holes fit over hooks projecting from the sides of the enclosure.

Still, the need remains for a simple means of mounting the insulation on the enclosure. The mounting should be inexpensive and easy to manufacture while securely holding the insulation on the enclosure. The tub and insulation should be easy to assemble and should resist inadvertent removal of the insulation.

SUMMARY OF THE INVENTION

The present invention provides a washer, such as a domestic dishwasher. The washer includes a tub having an external surface and defining an internal volume in which objects are washed. An aperture and a sheet of insulation are disposed on the external surface. A clip projects through the insulation and engages in the aperture to secure the insulation on the external surface.

A boss, integrally molded on the tub, extends from the external surface and defines the aperture. A second aperture is disposed on a side of the external surface opposite the first aperture. A second clip projects through the insulation and engages in the second aperture to secure the insulation on the external surface. Each aperture is located adjacent a lower edge of a vertical side wall of the tub. The clip has a plurality of opposed fingers engaging a wall of the aperture and a retaining surface engaging the insulation.

The tub is made of a bottom wall, rear wall, opposing side walls, and top wall defining the external surface. The aperture is disposed on a side wall and the sheet of insulation is disposed on the top and side walls. The second aperture is disposed on a side wall opposite the first aperture. The second clip projects through the insulation and engages in the second aperture to secure the insulation on the external surface. A tab is disposed along an edge of the top wall. The tab extends through a perforation at an edge of said sheet of insulation.

The invention also provides a method of installing insulation on the washer tub. The steps include locating the insulation on the external surface of the tub and inserting a retainer clip through the insulation into an aperture on the external surface of the tub. The retainer clip engages in the aperture to retain the insulation on the external surface. A second retainer clip is inserted through the insulation into a second aperture on a side of the external surface of the tub opposite the first aperture to retain the insulation on the external surface. A perforation in the sheet is hooked over a tab disposed on the top wall.

DESCRIPTION OF THE PREFERRED EMBODIMENTS

Figure 1:
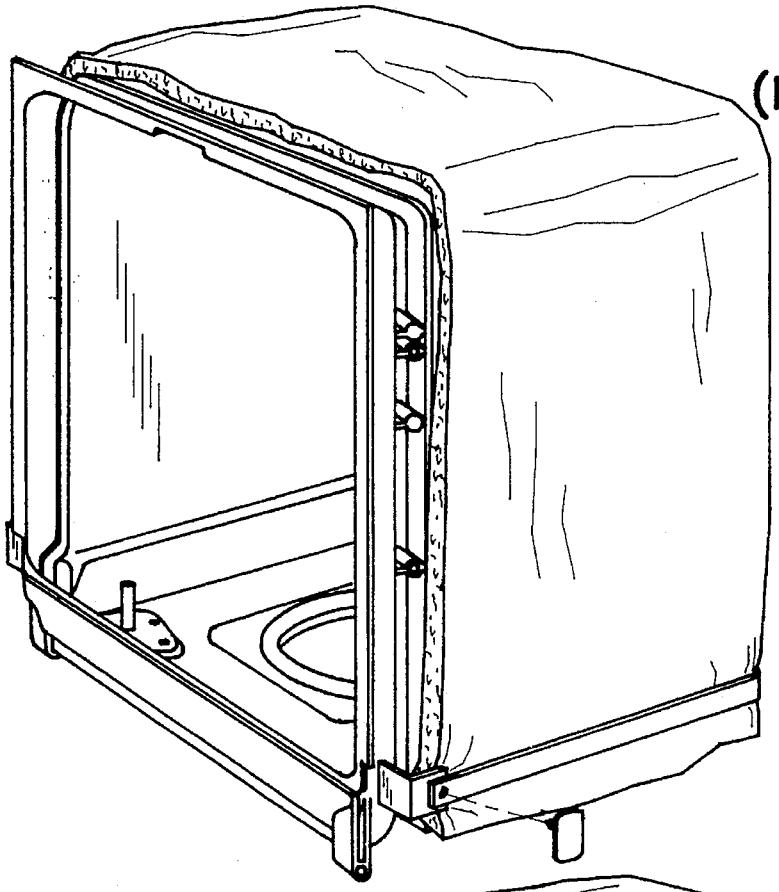
Fig.1 (PRIOR ART)
FIG. 1 shows a prior art manner of mounting insulation on a dishwasher.
Figure 2:
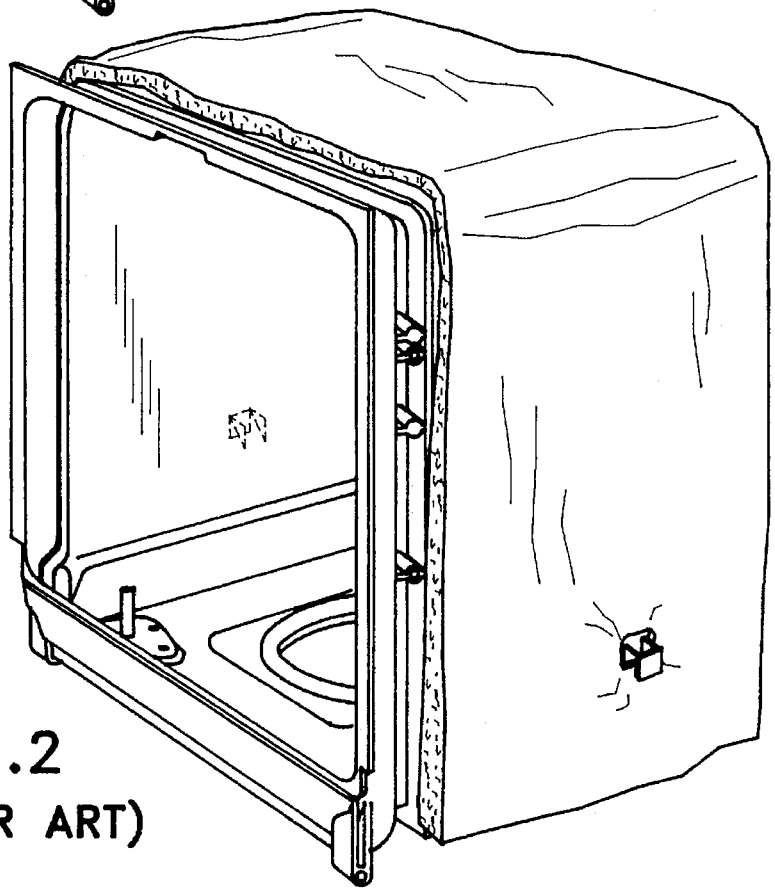
Fig.2 (PRIOR ART)
FIG. 2 shows another prior art manner of mounting insulation on a dishwasher.
Figure 3:
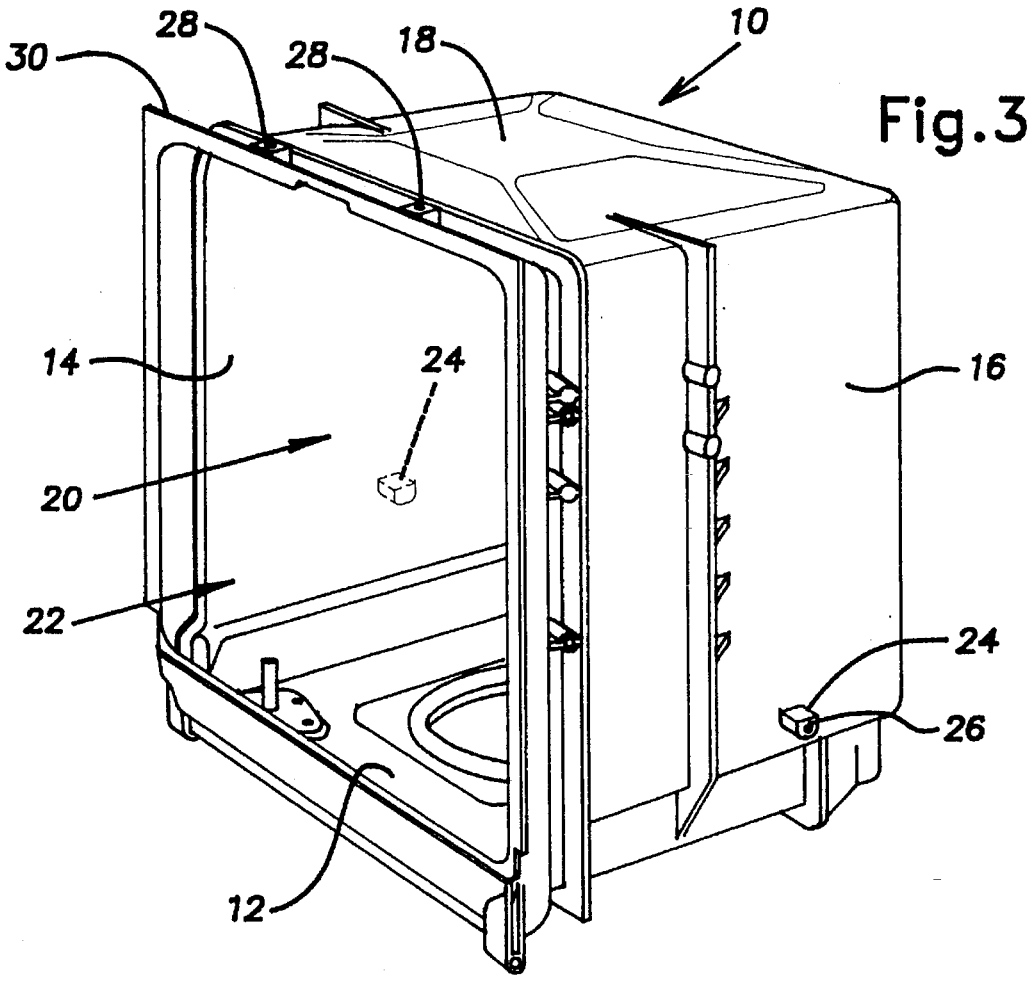
FIG. 3 shows a perspective view of a dishwasher tub according to the invention.

Referring to FIG. 3, a washer, such as a dishwasher, is provided with a molded dishwasher tub 10. The tub 10 has a bottom wall 12, left side wall 14, right side wall 16, rear wall (not shown), and a top wall 18. The walls 12, 14, 16, 18 define an internal volume 20 or washing chamber in which objects are washed. The walls also define an external surface of the tub 10. The tub 10 defines an opening 22 through which the objects are inserted into and removed from the internal volume 20. The tub 10 is generally of a type known in the art and can be modified in its details to accommodate particular features of the dishwasher. The tub 10 is adapted for mounting a door to close the opening 22. A reinforcing frame can be located on the outside of the tub 10, and racks and a water spraying system are located on the inside.

Insulation mounting bosses 24 are molded on lower parts of the opposite side walls 14, 16. Each boss 24 is a generally cylindrical or parallelepipedic member projecting outwardly from an external surface of the respective side wall 14, 16. A central aperture 26, such as a bore, is provided in each boss 24. If tub 10 geometry permits, the apertures 26 can be provided directly in the side walls 14, 16 or another structural element of the tub 10, so long as the possibility of water leakage is considered. In a conventional manner, L-shaped plastic or metal mounting tabs 28 are provided on the top wall 18 at a front flange 30 around the opening 22. The tabs 28 are adapted for fastening the tub to the underside of a countertop (not shown) with screws.

Figure 4:
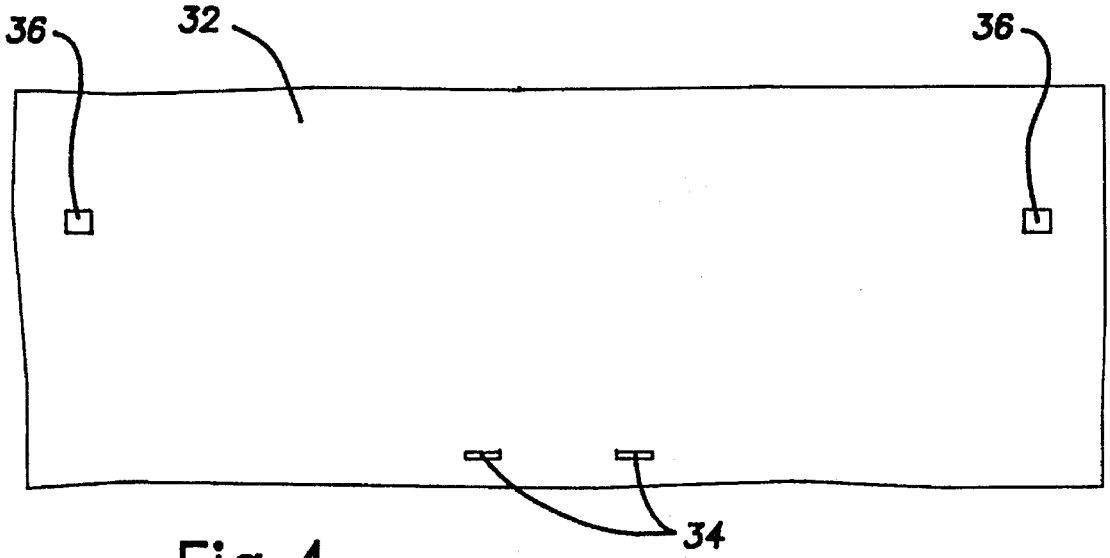
FIG. 4 shows a sheet of insulation.

Referring to FIG. 4, a rectangular sheet 32 of insulation, such as a batt or blanket of fiberglass, has a width approximately equal to the depth of the tub 10. The length of the sheet 32 is approximately equal to the sum of the heights of the side walls 14, 16 and the width of the top wall 18. The sheet 32 of insulation is preferably lined with paper or plastic on one or two sides and is suitable for limiting noise and vibrations emanating from the tub 10 during a washing operation and also retains heat in the tub. The sheet 32 is provided with edge perforations 34, such as holes or slots, along a long edge of the sheet 32. The edge perforations 34 are symmetrically spaced and adapted to receive the mounting tabs 28 therethrough. Mounting holes 36 are provided near the short edges of the sheet 32. The mounting holes 36 are adapted to receive the mounting bosses 24 therethrough.

Figure 5:
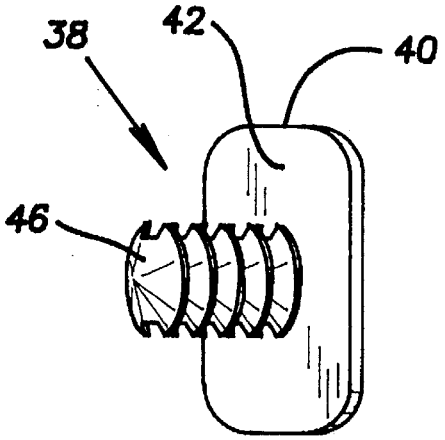
FIG. 5 shows a perspective view of a mounting clip according to the invention.
Figure 6:
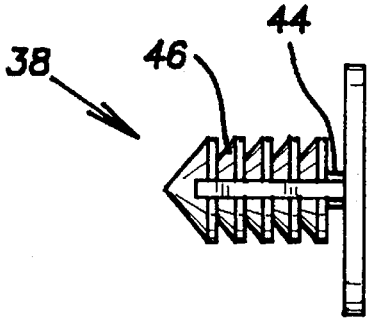
FIG. 6 shows a side view of the mounting clip.

Referring to FIGS. 5 and 6, a mounting clip 38 has a generally planar base 40 defining a retaining surface 42. A post 44 extends from the retaining surface 42 and has a plurality of fingers 46 projecting therefrom. The clip 38 is preferably made of nylon and is relatively rigid. The fingers 46 are inclined and flex slightly toward the retaining surface 42. The clip 38 is adapted to fit snugly in the aperture 26 of the mounting boss 24 such that the fingers 46 firmly engage an inner wall of the aperture 26. The retaining surface 42 is substantially larger than the hole 36 in the insulation 32 to prevent passage of the base 40 through the hole 36.

Figure 7:
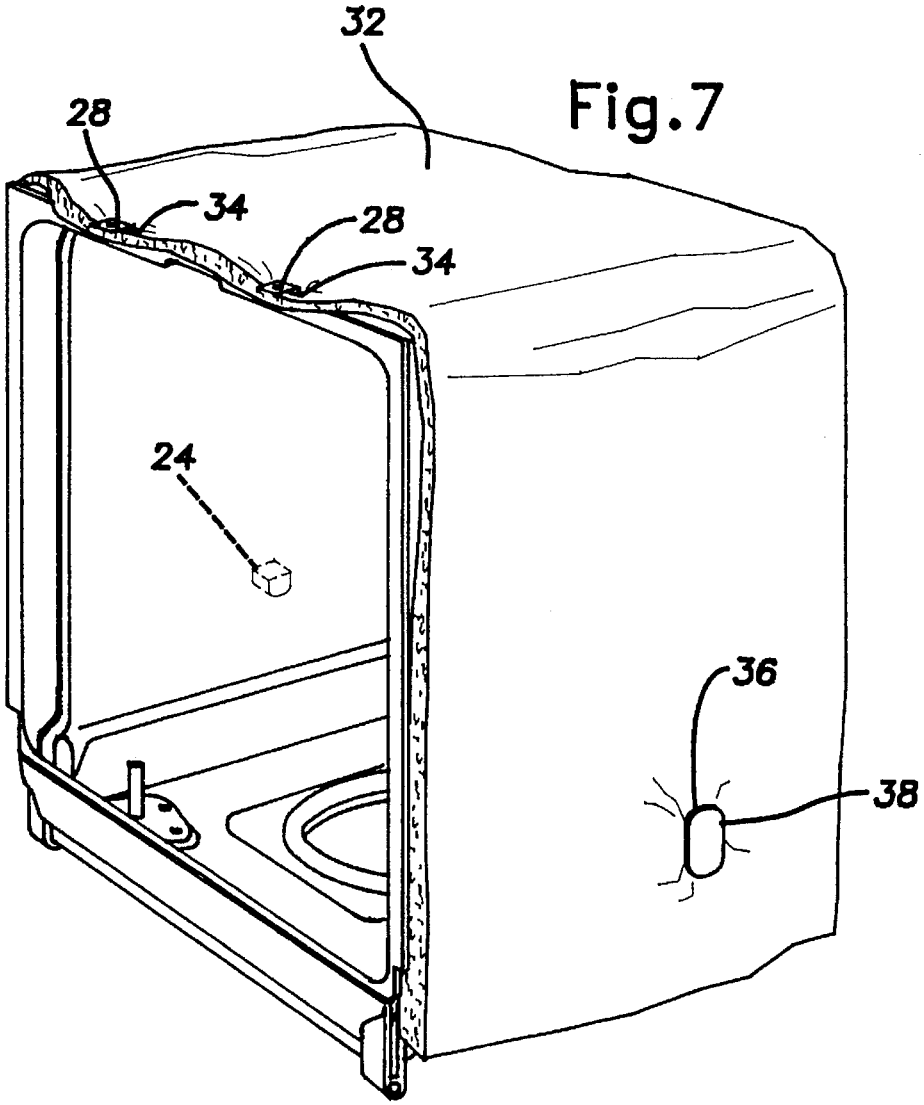
FIG. 7 shows the tub of FIG. 3 with the sheet of insulation of FIG. 4 installed thereon.

Referring to FIG. 7, the perforations 34 are hooked over the tabs 28. The sheet 32 of insulation is draped over the tub 10 with the tabs 28 extending through the perforations 34. The mounting holes 36 are located over the bosses 24 so that the bosses project therethrough. The clips 38 are installed in the apertures 26 of the bosses 24. The clips 38 engage and are firmly held in the apertures 26 so that the retaining surfaces 42 engage a surface of the sheet 32 to retain the sheet 32 on the side walls 14, 16 of the tub 10.

The present disclosure describes several embodiments of the invention, however, the invention is not limited to these embodiments. Other variations are contemplated to be within the spirit and scope of the invention and appended claims.

What is claimed is:

1. A washer, comprising:

a tub having an external surface and defining an internal volume in which objects are washed, said tub having a tab disposed adjacent an Upper edge of a top wall of said tub;

an aperture disposed on the external surface;

a sheet of insulation disposed on the external surface, said insulation defining a perforation along an edge of said insulation, said tab extending through said perforation; and a clip projecting through the insulation and engaging in the aperture to secure the insulation on the external surface.

2. A washer according to claim 1, further comprising a boss extending from the external surface and defining the aperture.

3. A washer according to claim 2, wherein the boss is integrally molded on the tub.

4. A washer according to claim 1, further comprising a second aperture disposed on a side of the external surface opposite the first aperture; and a second clip projecting through the insulation and engaging in the second aperture to secure the insulation on the external surface.

5. A washer according to claim 4, wherein each aperture is located adjacent a lower edge of a vertical side wall of the tub.

6. A washer according to claim 1, wherein the clip has a plurality of opposed fingers engaging a wall of the aperture.

7. A washer according to claim 1, wherein the clip has a retaining surface engaging the insulation.

8. A washer, comprising:

a molded tub having an external surface and defining an internal volume in which objects are washed;

a boss molded on the external surface of the tub and defining an aperture therein;

a sheet of insulation disposed on the external surface; and a clip projecting through the insulation into the aperture, said clip having a plurality of opposed fingers engaging the boss and a retaining surface engaging the insulation to secure the insulation on the external surface.

9. A washer according to claim 8, wherein the tub comprises a bottom wall, rear wall, opposing side walls, and top wall defining the external surface, said aperture being disposed on a side wall and said sheet of insulation being disposed on the top and side walls.

10. A washer according to claim 9, further comprising a second aperture disposed on the side wall opposite the first aperture; and a second clip projecting through the insulation and engaging in the second aperture to secure the insulation on the external surface.

11. A washer, comprising:

a molded tub having a bottom wall, rear wall, opposing side walls, and top wall defining an external surface and further defining an internal volume in which objects are washed;

a boss molded on the side wall of the tub and defining a first aperture therein;

a second aperture disposed on the side wall opposite the first aperture;

a sheet of insulation disposed on the top and side walls;

a first clip projecting through the insulation into the aperture, said clip having a plurality of opposed fingers engaging the boss and a retaining surface engaging the insulation to secure the insulation on the external surface;

a second clip projecting through the insulation and engaging in the second aperture to secure the insulation on the external surface; and a tab disposed along an edge of the top wall and a perforation at an edge of said sheet of insulation, said tab extending through the perforation.

12. A method of installing insulation defining at least one mounting hole on a washer tub having side walls and a top wall defining an external surface and an internal volume for washing objects, said side walls having at least one insulation mounting boss extending therefrom, said boss defining an aperture, said method comprising the steps of:

locating the insulation on the external surface of the tub;

inserting said at least one mounting boss through said at least one mounting hole; and inserting a retainer clip through the insulation into said aperture defined in said boss on the external surface of the tub, said retainer clip engaging in the aperture to retain the insulation on the external surface.

13. A method according to claim 12, further comprising the step of inserting a second retainer clip through the insulation into a second aperture on a side of the external surface of the tub opposite the first aperture to retain the insulation on the external surface.

14. A method of installing insulation on a washer tub having side walls and a top wall defining an external surface and an internal volume for washing objects, comprising the steps of:

locating the insulation on the external surface of the tub;

inserting a retainer clip through the insulation into an aperture on the external surface of the tub, said retainer clip enraging in the aperture to retain the insulation on the external surface;

inserting a second retainer clip through the insulation into a second aperture on a side of the external surface of the tub opposite the first aperture to retain the insulation on the external surface; and hooking a perforation in the sheet over a tab disposed on the top wall.

* * * * *

UNITED STATES PATENT AND TRADEMARK OFFICE

CERTIFICATE OF CORRECTION

PATENT NO. : 5,549,760

DATED : August 27, 1996

INVENTOR(S) : Craig H. Becker

It is certified that error appears in the above-indentified patent and that said Letters Patent is hereby corrected as shown below:

Column 3, line 37 (Claim 1, line 4), delete "Upper" and insert --upper--.

Column4, line 66 (Claim 14, line 8), delete "enraging" and insert --engaging--.

Signed and Sealed this

Third Day of December, 1996

*Attest:*

*Attesting Officer*

BRUCE LEHMAN

*Commissioner of Patents and Trademarks*